United States Patent [19]

Pucci

[11] Patent Number: 4,864,773

[45] Date of Patent: Sep. 12, 1989

[54] AWNING-TYPE WINDOW LOCK

[76] Inventor: Dominic Pucci, 2121 NE. 31st St., Lighthouse Point, Fla. 33064

[21] Appl. No.: 129,837

[22] Filed: Dec. 8, 1987

[51] Int. Cl.[4] ..... E05C 19/02

[52] U.S. Cl. ..... 49/394; 49/110

[58] Field of Search ..... 49/394, 395, 107, 110, 49/141, 56

[56] References Cited

U.S. PATENT DOCUMENTS

| | | | |
|---|---|---|---|
| 355,200 | 12/1886 | Never | 49/356 |
| 532,483 | 1/1895 | Poertner et al. | 49/356 |
| 889,453 | 6/1908 | Gerson | 49/394 X |
| 1,590,441 | 6/1926 | Piggot | 49/394 X |
| 1,591,650 | 7/1926 | Tomlinson | 49/356 |
| 2,094,990 | 10/1937 | Lang | 49/394 X |
| 2,997,754 | 8/1961 | Walden | 49/394 |
| 3,305,971 | 2/1967 | Golen | 49/394 X |
| 3,444,648 | 5/1969 | Anderson et al. | 49/394 X |
| 3,747,272 | 7/1973 | Martin | 49/356 |
| 3,942,286 | 3/1976 | Ehret et al. | 49/141 |
| 3,987,586 | 10/1976 | Rifkin | 49/394 |
| 3,994,095 | 11/1976 | Hare | 49/356 |
| 4,055,360 | 10/1977 | Russi | 49/141 X |
| 4,070,048 | 1/1978 | Young | 49/141 X |
| 4,259,811 | 4/1981 | Davis | 49/356 |
| 4,616,863 | 10/1986 | Bryant | 49/56 X |
| 4,620,393 | 11/1986 | Stafset | 49/394 |

*Primary Examiner*—Philip C. Kannan

*Attorney, Agent, or Firm*—Malin, Haley, & McHale

[57] ABSTRACT

The invention relates to a means for locking an awning/vent type window wherein pear-shaped apertures are provided on the window frame that cooperate with pin means projecting from the vent. As the vent is drawn into a closed position, the pin means enters an enlarged portion of the pear shaped aperture and subsequent relative movement between the pin means and the pear shaped aperture brings about engagement of the pin means with the smallest portion of the pear shaped apertures.

10 Claims, 2 Drawing Sheets

AWNING-TYPE WINDOW LOCK

BACKGROUND OF THE INVENTION

The invention relates to a locking means for awning/-vent type windows. In the past, many awning windows have not included locks for the window other than a mechanical drive means which is utilized to open or close the window or position it in any of the many intermediate positions therebetween. Such windows either require separate locking devices attached by the home owner or else the windows are not burglar proof. There have been many attempts in the past to overcome these problems. However, all prior known attempts to provide a solution have required extensive modification to the linkage arm, cam mechanism or other similarly complicated mechanisms.

SUMMARY OF THE INVENTION

The invention relates to a means for locking an awning/vent type window wherein pear-shaped apertures are provided on the window frame that cooperate with pin means projecting from the vent. As the vent is drawn into a closed position, the pin means enter an enlarged portion of the pear shaped apertures and subsequent relative movement between the pin means and the pear shaped aperture brings about engagement of the pin means with the smaller portion of the pear shaped apertures.

OBJECTS OF THE INVENTION

One of the objects of the invention is to provide an economical lock mechanism which can easily be installed on existing window units.

Another object of the invention is the provision of means whereby newly manufactured units can be provided with the novel locking means.

A further object of the invention is to provide an embodiment having a locking means for an awning window of the type wherein there is an upward lift action imparted to the window sash as it closes.

A still further object of the invention is to provide an embodiment having a locking means for an awning window of the type wherein the window sash pivots into its closed position without any lift action being imparted to the window sash.

The above described features and other objects and advantages will become more apparent and better understood as the details of the invention are more fully described and claimed, reference being made to the accompanying drawing which form a part hereof, wherein like reference numerals refer to the same elements throughout the specification.

BRIEF DESCRIPTION OF THE DRAWING

FIG. 3 is a detailed view of the locking bar used in FIGS. 1 and 2.

DETAILED DESCRIPTION OF THE PREFERRED EMBODIMENT

Figure 1:
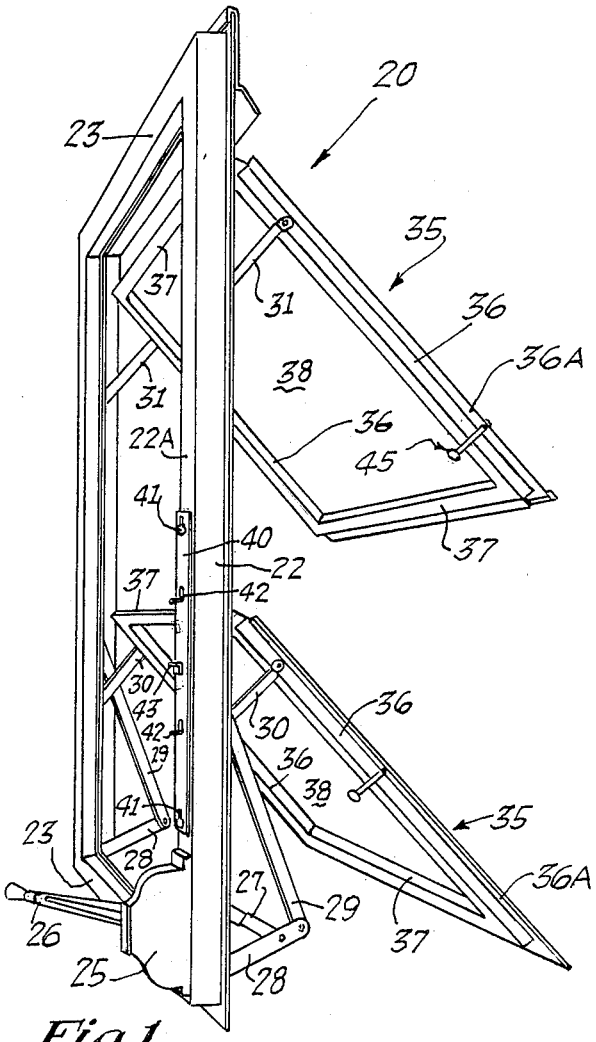
FIG. 1 is a perspective view of an awning/type window with the locking device of the present invention incorporated in a no-lift type window.

In FIG. 1 there is shown a conventional two panel aluminum awning type window assembly. As shown in FIG. 1, the window assembly is provided with the main frame member 21 and a plurality of window sashes 35. Although the two window sashes 35 are shown, the invention is equally applicable to a single sash as well as a multi-sash unit in excess of two sashes. There is also shown a conventional operator mechanism 25 including a crank arm 26 which is securely mounted on one of the two vertical members 22 which together with two additional upper and lower horizontal members 23 make up the main frame member 21.

As indicated earlier, the embodiment of FIG. 1 is directed to a conventional two sash aluminum awning window wherein there is no lift action imparted to the individual window sash 35 as the window sashes 35 are moved into their final closing position. As crank arm 26 is rotated in the appropriate direction, operator mechanism 25 actuates lever arms 27, 28, 29, 30 and 31 resulting in a closing of window sash 35. Window sashes 35 are formed by two vertically spaced members 36 and two horizontally spaced members 37 with appropriate seal means (not shown) for receiving the window panes 38. Slidably mounted to one of the vertical members 22 is slide bar 40 which is provided with a pair of pear-shaped slots 41 and a pair of tracking slots 42 with a finger lift 43 separating these slots. As shown a first pear shaped slot and tracking slot 42 is positioned above finger lift 43 with the second pear shaped slot 41 and tracking slot 42 positioned below finger lift 43. Slide bar 40 is slidably attached to vertical member 22 by screws or rivets (not shown) which are inserted into the tracking slots 42 and vertical frame member 22. It must be kept in mind that prior to securing slide bar 40 to front face 22A of vertical member 22 appropriate apertures must be provided to permit the adjustable head 46 of locking post 45 to pass therethrough and enter the pear-shaped slots 41. Attached to vertical member 36A of window sash 35 is locking post 45 which is provided with an adjustable head 46.

Figure 2:
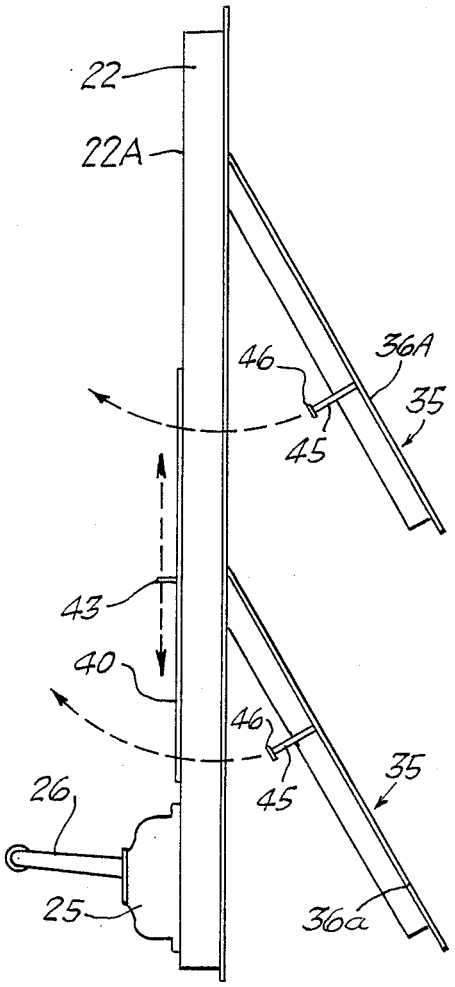
FIG. 2 is a side view of the window shown in FIG. 1 illustrating the movement of the window sashes and the locking device.

Referring now to FIG. 2, there is shown a side view illustrating pivoting action of window sashes 35 and the arcuate path of locking post 45. As window sashes 35 are pivoted into its closed position, locking post 45 enter the apertures in front face 22A of vertical members 22 and also pear shaped slots 41 of sliding bar 40. After he closing of window sashes 35 is completed, adjustable head 46 will appear inward of slide bar 40. To lock window sash 35 a downward force is applied to finger lift 43. Thus, slide bar 40 is moved downward and locking posts 45 will be kept locked in place when the reduced width of pear shaped slots 41 slide behind adjustable head 46.

Figure 3A:
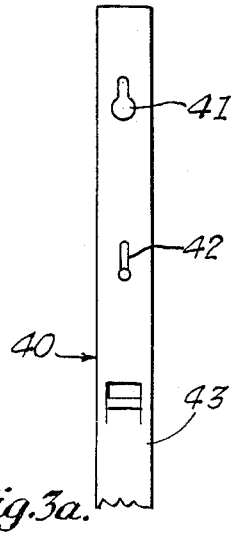
FIG. 3A is a side view of the locking bar shown in FIG. 3.
Figure 3A:
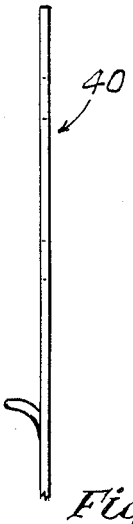

FIG. 3 is a detail of the upper half of slide bar 40, although not shown, the lower half of slide bar is provided with the second tracking slot 42 spaced the same distance from finger lift 43 as upper tracking slot 42 and also a second pear shaped slot 41 similarly positioned below second track slot 42.

FIG. 3A is an end view of slide bar 40 illustrating its relative thickness and the length of finger lift 43.

Figure 4:
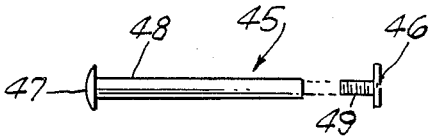
FIG. 4 is a detailed view of the locking post used in FIGS. 1, 2 and 5.

FIG. 4 is a detail of locking post 45. Locking post 45 is provided with an adjustable head 46 and a fixed head 47. Projecting from fixed head 47 is a relatively long bolt portion which is hollow at its distal end and provided with internal threads (not shown). Adjustable head 46 is provided with a threaded stem portion 49 to permit threading it into the internal threads of bolt portion 48.

Figure 5:
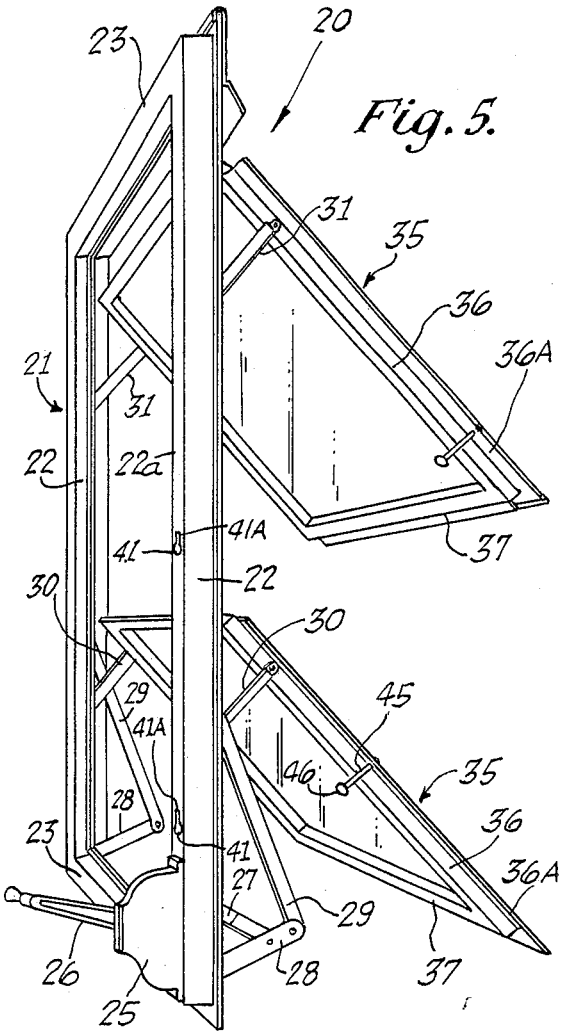
FIG. 5 is a perspective view of an awning type window with the locking device incorporated in a lift type window.

FIG. 5 is a perspective view similar to that of FIG. 1 with the exception that pear shaped slots 41 are located on front face 22A of vertical member 22. However, window assembly 20 is a type wherein sashes 35 are pivoted inward when crank arm 26 is rotated in the appropriate direction and immediately prior to the closing of sashes 35 there is a slight upward lift imparted thereto. It is at this point, that adjustable head 46, having entered pear shaped slot 41 will be raised due to the lift action and enters the narrower portion 41A of pear shaped slot 41. Thus securely locking sashes 35 in the closed position. Adjustable head 46 may be threaded into or out of bolt portion 48 to accommodate any adjustments required. The adjustment need only be made once, i.e. once the locking posts 45 are initially installed and normally no further adjustments will be required.

When crank arm 26 is rotated in the opposite direction to open, sashes 35 first move slightly in a downward direction. As a result of this slight downward movement, locking post 45 has also been moved the same amount down narrow portion 41A and adjustable head 46 is now aligned with the enlarged portion of pear shaped slot whereby further rotation of crank arm 26 in the opening direction permits adjustable head 46 to pass through pear shaped slot 41 thus permitting sashes 35 to open.

Figure 6:
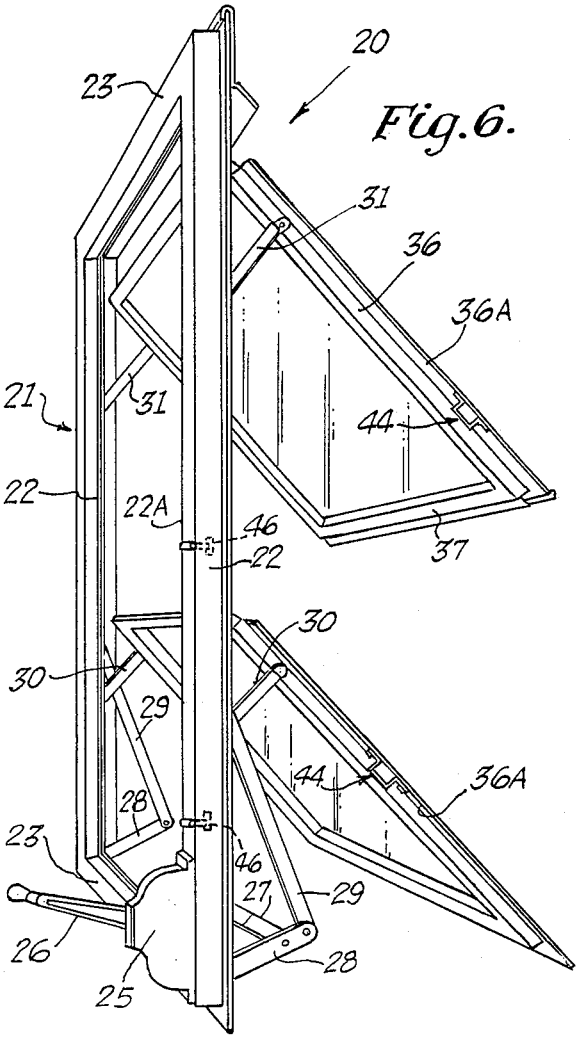
FIG. 6 is a view similar to FIG. 5, however the location of the male and female locking elements are reversed.

Referring now to FIG. 6 there is illustrated a window assembly 20 which is identical to that shown in FIG. 5. Here again, as in FIG. 5, a slight lift action is imparted to sashes 35 as they approach the final stage in closing and subsequently, on the initial stage of opening a slight downward lowering action is imparted to sashes 35 as crank arm 26 is rotated in the opening direction. Since awning windows of this type are well known and readily available the details of the linkage mechanism has not been illustrated or described further.

Figure 7:
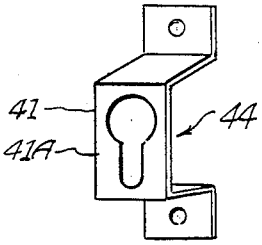
FIG. 7 is a detailed view of the female locking elements used in FIG. 6.

In FIG. 6, a retaining clip 44 is mounted to the inside face of flange 36 by means of rivets, welds or the like and the locking post 45 is secured through front face **22*a* to the inside of channel-like vertical member 22. The principle of operation is the same as that described in reference to FIG. 5. The difference between the two FIGS. being that the location of the locking posts 45 and the pear shaped slots 41 are reversed. Additionally, pear shaped slot is formed in a retaining clip 44 as shown in greater detail in FIG. 7. Since retaining clip 44 is mounted on flange 36A of vertical member 36 and vertical member 22*a* is channel-shaped with its open side facing outward, retaining clip 44 is received in the open channel. Thus FIG. 6 provides a locking system wherein the locking elements are all hidden from view when the window sashes 35 are in their closed position. Only the smooth rivet heads will be visible from outside and if retaining clip 44** were to be electronically welded, there would be nothing visible from the outside.

Figure 8:
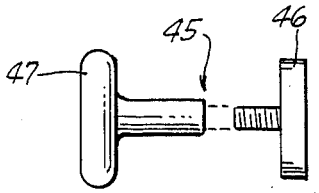
FIG. 8 is a view of a shorter locking post as used in FIG. 6.

Cooperating with retaining clip 44 is locking post 45 which functions in the same manner as locking post 45 of FIG. 4. However, the overall length of locking post 45 of FIG. 8 is shorter. Locking post 45 is attached to front face 22A of vertical member 22 with adjustable head 46 projecting into the open channel of vertical member 22. After adjustment is made to adjustable head 46 no further adjustment is normally required.

Figure 9:
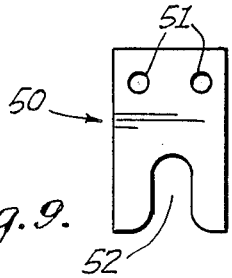
FIG. 9 is a front view of a modified female locking element.

FIG. 9 is an illustration of a modified retaining clip 50 which is provided with a pair of mounting apertures 51 and a female opening 52 for receiving the bolt portion of locking post 45.

Figure 10:
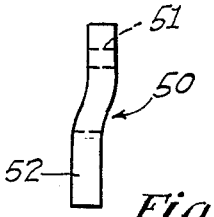
FIG. 10 is a side view of the locking element shown in FIG. 9.

FIG. 10 is a side view of modified retaining clip 50. The main purpose of this FIG. is to illustrate the amount of offset "D" between the upper and lower positions of retaining clip 50. The offset "D" need only be slightly greater than the thickness of adjustable head 46 since it has to slide behind the offset portion when in the locked position.

Although only a single locking post 45 is utilized for each window sash 35, additional locking posts 45 may be used. However, it has been found that a single locking post 45 is sufficient to provide the desired security.

The foregoing is considered as illustrative only of the principles of the invention. Further, since various modifications and changes may readily occur to those skilled in the art, it is not desired to limit the exact construction and operation shown and described, and accordingly all suitable modifications and equivalents may be resorted to as falling within the scope of the invention as claimed.

Having thus described our invention, we claim:

1. A releasable locking means in combination with a main frame means and a movable closure assembly, said main frame means providing support for said movable closure assembly, said locking means mounted on an inside portion of movable closure assembly, restraining means positioned on an inside face of said main frame means to cooperate with said locking means to permit locking of said movable closure assembly when said movable closure assembly is retracted to its closed position;

said locking means comprises a locking post which is securely fastened to said outwardly opening closure assembly;

said restraining means comprises fixed aperture means having a first enlarged portion and a second smaller portion extending therefrom whereby closing of said closure assembly brings said locking means into said enlarged portion of said aperture means and continued closing of said closure assembly results in a slight lift action being imparted to said closure assembly to engage said locking means with said smaller portion of said fixed aperture means.

2. A releasable locking means of the character defined in claim 1 wherein said locking means comprises a plurality of locking posts.

3. In an awning window construction having a main frame, at least one vent window frame mounted for movement into an opened and closed position relative to said main frame, restraining means provided on an inside face of said main frame; locking post means attached to said at least one vent window frame whereby said locking post means is operatively engaged with said restraining means when said at least one vent window frame is retracted to tis fully closed position;

wherein said restraining means comprises aperture means in said main frame and a slide bar having at least one pear shaped slot therein; said locking post means entering said aperture means and said pear shaped slot whereby downward movement of said slide bar prevents said at least one window frame from opening.

4. In an awning window construction having a main frame, at least one vent window frame mounted for movement into an opened and closed position relative to said main frame, restraining means provided on an inside face of said main frame; locking post means attached to said at least one vent window frame whereby said locking post means is operatively engaged with said restraining means when said at least one vent window frame is retracted to its fully closed position;

wherein said restraining means comprises aperture means in said main frame, said aperture means comprises a pear shaped slot having an enlarged portion and a narrower portion extending from said enlarged portion, said locking post means comprising a bolt portion fixedly attached to said vent window frame, an adjustable head threadably received in the free end of said bolt portion whereby said adjustable head is received in said aperture of said main frame during closing of said at least one vent window frame and a slight lift action is imparted to said at least one vent window to move said bolt portion of said locking post into said narrower portion of said pear shaped slot and permit said enlarged head of said locking post means to prevent opening of said at least one vent window frame.

5. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said frame and said at least one vent window frame, restraining means mounted on the other of said main frame and said at least one vent window frame cooperating with said locking means to lock said at least one vent window frame when said slight action is imparted thereto;

wherein said locking means is positioned on said main frame and said restraining means is positioned on said vent window frame;

wherein said locking means comprises a locking post having an adjustable head at its distal end and said restraining means comprises a pear shaped slot in an inner face of said main frame.

6. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said main frame and said at least one vent window frame, restraining means mounted on the other of said main frame and said at least one vent window frame cooperating with said locking means to lock said at least one vent window frame when said slight action is imparted thereto;

said locking means being positioned on said vent window frame and said restraining means being positioned on said main frame;

wherein said locking means comprises a locking post having an adjustable head at its distal end and said restraining means comprises a pear shaped slot in an inner face of said main frame to admit said adjustable head therethrough.

7. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said main frame and said at least one vent window frame, restraining means mounted on the other of said main frame and said at least one vent window frame cooperating with said locking means to lock said at least one vent window frame when said slight action is imparted thereto;

wherein said locking means is positioned on said vent window frame and said restraining means is positioned on said main frame;

wherein said restraining means comprises a pear shaped slot formed in the front face of said main frame.

8. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said main frame and said at least one vent window frame, restraining means mounted on the other of said main frame and said at least one vent window frame cooperating with said locking means to lock said at least one vent window frame when said slight action is imparted thereto;

wherein said locking means is positioned on said main frame and said restraining means is positioned on said vent window frame;

wherein said restraining means comprises a retaining clip having a pear shaped slot formed therein fixedly attached to said vent window frame and is received within a channel portion of said main frame whereby said retaining clip is hidden from view when said vent window frame is moved to tis closed position.

9. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said main frame and said at least one vent window frame, restraining means mounted on the other of said main frame and said at least one vent window frame cooperating with said locking means to lock said at least one vent window frame when said slight action is imparted thereto;

wherein said locking means is positioned on said main frame and said restraining means is positioned on said vent window frame;

wherein said retaining means comprises a retaining clip having a plurality of spaced mounting apertures therein and an offset portion with a centrally located female opening for receiving said locking means.

10. In an awning window construction having a main frame, at least one vent window frame mounted for pivotal movement into an opened and closed position relative to said main frame, linkage means operatively connecting said main frame to said at least one vent window frame; crank means mounted on an inside face of said main frame and operatively connected to said linkage to impart a pivotal closing movement to said at least one vent window frame upon initial rotation of said crank arm and subsequently impart a predetermined lift action to said at least one vent window frame during final closing, locking means positioned on one of said main frame and said at least one vent window frame, restraining means mounted on the other of said main frame and said at least one vent window frame cooperating with said locking means to lock said at least one vent window frame when said slight action is imparted thereto;

wherein said locking means is positioned on said vent window frame and said restraining means is positioned on said main frame;

wherein said retaining means comprises a retaining clip having a plurality of spaced mounting apertures therein and an offset portion with a centrally located female opening for receiving said locking means.

* * * * *